US006530862B2

(12) United States Patent
Kolmanovsky

(10) Patent No.: US 6,530,862 B2
(45) Date of Patent: Mar. 11, 2003

(54) SYSTEM AND METHOD FOR COMPRESSION BRAKING WITHIN A VEHICLE HAVING A VARIABLE COMPRESSION RATIO ENGINE

(75) Inventor: Ilya V Kolmanovsky, Ypsilanti, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/757,198

(22) Filed: Jan. 9, 2001

(65) Prior Publication Data

US 2002/0091037 A1 Jul. 11, 2002

(51) Int. Cl.[7] ..... B60K 9/06
(52) U.S. Cl. ..... 477/203; 477/117; 477/118
(58) Field of Search ..... 477/203, 204, 477/205, 207, 115, 117, 118, 121; 123/48, 48 B, 322, 321, 48 R, 78 E, 78 F, 197.4, 197.3

(56) References Cited

U.S. PATENT DOCUMENTS 3,667,579 A 6/1972 Vizza
4,282,957 A * 8/1981 Sugimoto et al. ..... 192/220
4,314,487 A 2/1982 Ahlen
4,355,605 A 10/1982 Robinson et al.
4,933,850 A 6/1990 Wheeler
4,987,863 A * 1/1991 Daly ..... 123/48 AA
5,121,723 A 6/1992 Stepper et al.
5,178,103 A * 1/1993 Simko ..... 123/48 B
5,476,074 A * 12/1995 Boggs et al. ..... 123/48 B
5,526,784 A * 6/1996 Hakkenberg et al. ..... 123/322
5,595,146 A * 1/1997 Bollig et al. ..... 123/48 B
5,615,653 A 4/1997 Faletti et al.
5,718,199 A * 2/1998 Hu et al. ..... 123/322
5,733,219 A 3/1998 Rettig et al.
5,816,665 A 10/1998 Burnett et al.
5,887,434 A 3/1999 Arnell et al.
5,921,883 A * 7/1999 Bellinger ..... 123/322
6,085,524 A 7/2000 Persson
6,230,671 B1 * 5/2001 Achterberg ..... 123/48 R
6,321,717 B1 * 11/2001 Faletti ..... 123/321
6,349,253 B1 * 2/2002 Bellinger ..... 701/53
6,446,598 B1 * 9/2002 Funke et al. ..... 123/321

* cited by examiner

*Primary Examiner*—Charles A. Marmor
*Assistant Examiner*—David D. Le
(74) *Attorney, Agent, or Firm*—Chupa & Alberti, P.C.

(57) ABSTRACT

A system and method for braking a vehicle 12 having a variable compression ratio engine 14 and a compression braking system 16. System 10 is adapted to utilize the variable compression ratio engine 14 and the compression braking system 16 in a synergistic manner to selectively control and/or vary the generated compression braking torque.

16 Claims, 2 Drawing Sheets

SYSTEM AND METHOD FOR COMPRESSION BRAKING WITHIN A VEHICLE HAVING A VARIABLE COMPRESSION RATIO ENGINE

FIELD OF THE INVENTION

This invention relates to a system and a method for compression braking within a vehicle having a variable compression ratio engine and more particularly, a compression braking system and method which utilizes the advantages and flexibility of a variable compression ratio engine to selectively augment and/or vary the produced braking torque.

BACKGROUND OF THE INVENTION

Compression braking systems are typically employed within relatively large or commercial type vehicles and are effective to augment the torque provided by conventional friction braking assemblies and/or to regulate the speed of such vehicles. Compression braking is typically activated after the fuel supply has been "cut off" from the engine, such as when the vehicle is descending a steep grade. Compression braking is performed by providing resistance to airflow within the engine by changing valve timing and/or by other techniques. For example and without limitation, compression braking can be performed by opening a cylinder valve (e.g., an exhaust valve or a supplemental valve) at the end of a stroke, thereby releasing the potential energy stored in the compressed air into the atmosphere. In this manner, energy is removed from the driveshaft, thereby slowing the vehicle. Prior compression braking systems typically include several hydraulically actuated valves which communicate with various cylinders within the vehicle's engine and which are selectively opened to release compressed air from the cylinders.

Efforts have been made to improve the efficiency and fuel economy of a vehicle engine by selectively varying the compression ratio within the various cylinders of the engine. For example and without limitation, a variable compression engine may selectively alter the compression ratio within its various cylinders by opening and closing auxiliary chambers within the cylinder heads, or by varying the length of the pistons and/or piston rods. These types of engines provide greater flexibility, improved fuel economy and reduced knock. However, vehicles having these types of engines are typically braked using conventional friction brakes and/or conventional compression braking systems and strategies. These conventional compression braking systems and methods do not utilize the flexibility provided by variable compression ratio engines, and therefore, are not well suited for variable compression ratio engines.

There is therefore a need for a new and improved system and method for compression braking which is adapted for use with a variable compression ratio engine and which utilizes the flexibility of a variable compression ratio engine to controllably vary or augment braking torque and to regulate the speed of a vehicle.

SUMMARY OF THE INVENTION

A first non-limiting advantage of the invention is that it provides a system and method for compression braking which overcomes at least some of the previously delineated drawbacks of prior systems, assemblies and methodologies.

A second non-limiting advantage of the invention is that it provides a system and method for compression braking which is adapted for use in combination with a variable compression ratio engine and which utilizes the compression braking function with the variable compression ratio function in a synergistic manner to achieve a continuously varying compression braking torque.

A third non-limiting advantage of the invention is that it provides a system and method for compression braking which utilizes compression ratio changes to augment compression braking capability.

According to a first aspect of the present invention, a system for braking a vehicle is provided. The system includes a variable compression ratio engine which is selectively operable in a high compression ratio mode and in a low compression ratio mode; a compression braking system which selectively provides a compression braking torque; and a controller which is communicatively coupled to the variable compression ratio engine and to the compression braking system, the controller being effective to activate the compression braking system and to selectively cause the variable compression ratio engine to switch between the high compression ratio mode and the low compression ratio mode while the compression braking system is activated, thereby selectively varying the compression braking torque.

According to a second aspect of the present invention, a method is provided for braking a vehicle of the type having a compression braking system and a variable compression ratio engine. The method includes the steps of: activating the compression braking system, effective to produce a braking torque; and selectively altering the compression ratio within the variable compression ratio engine, thereby altering the produced braking torque.

These and other features, aspects, and advantages of the invention will become apparent by reading the following specification and by reference to the following drawings.

DETAILED DESCRIPTION OF THE PREFERRED EMBODIMENT OF THE INVENTION

Figure 1:
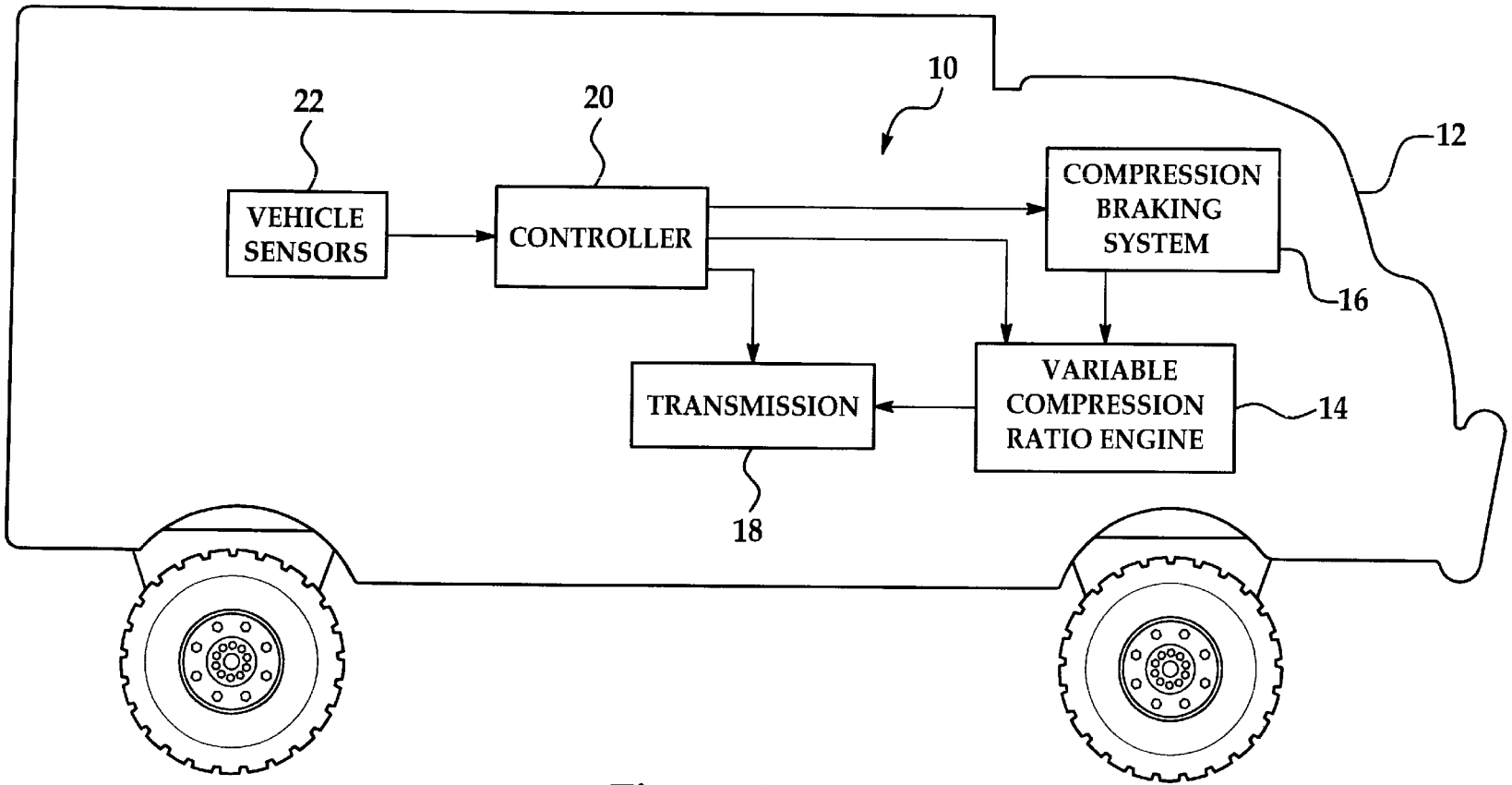
FIG. 1 is a block diagram of a compression braking system for use with a vehicle having a variable compression ratio engine and which is made in accordance with the teachings of the preferred embodiment of the invention.

Referring now to FIG. 1, there is shown a braking system 10 which is made in accordance with the teachings of the preferred embodiment of the invention and which is adapted to provide compression braking within a vehicle 12 having a variable compression ratio engine 14. Particularly, system 10 is adapted to utilize the variable compression ratio engine 14 and the compression braking system 16 in a synergistic manner to selectively control and/or vary the generated compression braking torque. In the preferred embodiment, vehicle 12 is a commercial type truck or industrial vehicle having a multi-gear transmission 18.

System 10 includes a conventional controller 20 operating under stored program control. Controller 20 is communicatively coupled to compression braking system 16, to variable compression ratio engine 14, and to transmission 18. Controller 20 includes one or more microprocessors which cooperatively perform the below-described compression braking strategy or method. As should also be apparent to one of ordinary skill in the art, controller 20 may actually comprise a plurality of commercially available, conventional, and disparate chips or devices, which are operatively and communicatively linked in a cooperative manner. In one alternate embodiment, controller 20 comprises a portion of a conventional engine control unit ("ECU"). Controller 20 is effective to control the compression braking function provided by system 16, the variable compression ratio function of engine 14 and the gear-switching functions of transmission 18. It should be appreciated that controller 20 may also control other vehicle and/or engine functions such as valve and/or spark timing and calibration.

Vehicle attribute sensors 22 comprise a plurality of conventional and commercially available sensors which measure information pertaining to the speed of vehicle 12 and other vehicle attributes. In the preferred embodiment of the invention, sensors 22 include one or more conventional wheel speed sensors. Sensors 22 provide data, such as vehicle speed and driver pedal position to controller 20, which utilizes these values, as discussed more fully and completely below, to control compression braking system 16, variable compression ratio engine 14, and transmission 18 in a synergistic manner to achieve a continuously varying and controllable compression braking torque and/or to regulate the speed of vehicle 12.

Variable compression ratio engine 14 is a conventional variable compression ratio engine having several cylinders (not shown) and which is able to selectively vary the compression ratio within the cylinders. In one non-limiting embodiment, engine 14 is a variable compression ratio engine of the type having auxiliary chambers which are selectively and communicatively coupled to the various cylinders of the engine 14 and which are selectively opened and closed to alter the compression ratio of the engine 14. In another non-limiting embodiment, engine 14 is a variable compression ratio engine of the type having selectively extendable pistons which are selectively extended or retracted to alter the compression ratio within the engine 14. In the preferred embodiment, engine 14 has at least two modes of variable compression operation, a high compression ratio mode in which the engine 14 operates at a relatively high compression ratio, and a low compression ratio mode in which the engine 14 operates at a relatively low compression ratio. In embodiments having auxiliary chamber type variable compression ratio engines, the auxiliary chambers are closed in high compression ratio mode, and the auxiliary chambers are open in low compression ratio mode. In embodiments having extendable piston type variable compression ratio engines, the pistons are extended in high compression mode, and the pistons are retracted in the low compression ratio mode. It should be appreciated that the present invention is not limited by the specific type of variable compression ratio engine utilized, but that the present invention can operate with any type of variable compression ratio engine.

Vehicle 12 further includes a conventional compression braking system 16 which is communicatively coupled to and/or which forms a portion of engine 14. In the preferred embodiment, compression braking system 16 includes several valves (not shown), each of which is disposed within a unique cylinder of engine 14 and each of which is selectively and hydraulically activated in a conventional manner, effective to selectively release compressed air from the cylinders at certain times when vehicle 12 is in a compression braking mode.

Figure 2:
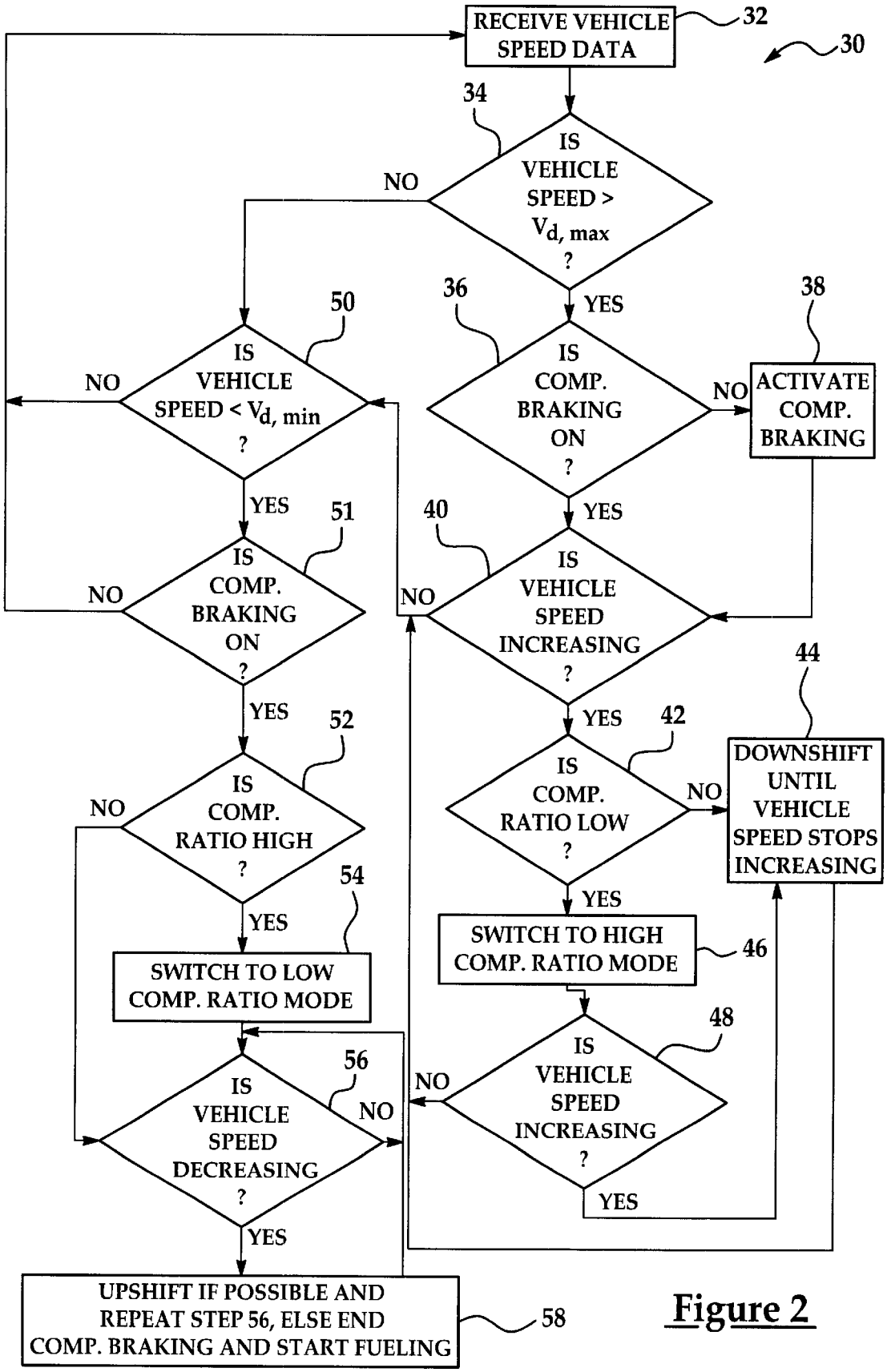
FIG. 2 is a flow diagram illustrating a one non-limiting method used by the preferred embodiment of the present invention to perform compression braking.

In operation, controller 20 coordinates the functions of the compression braking system 16, the variable compression ratio engine 14 and the transmission 18 to achieve a continuously varying and controllable compression braking torque. Referring now to FIG. 2, there is shown a block diagram 30 which illustrates one non-limiting embodiment of a method used by the present system 10 to control the compression braking function. The method 30 begins in functional block or step 32, where the controller 20 receives vehicle speed data from sensors 22. Controller 20 then compares the present vehicle speed to a maximum speed threshold value, $V_{d,max}$. If the measured vehicle speed does not exceed $V_{d,max}$, controller 20 proceeds to step 50. If the vehicle speed exceeds $V_{d,max}$, controller 20 proceeds to step 36 and determines whether the compression braking system 16 is activated. If the compression braking system 16 is not operating, controller 20 proceeds to step 38 and activates the compression braking system 16, thereby slowing the vehicle. In the preferred embodiment, controller 20 may ensure that other conditions are met prior to activating compression braking system 16. For example and without limitation, controller 20 may ensure that the vehicle's driver pedal or accelerator is not being depressed and/or that fuel is not currently being supplied to the engine. Once the compression braking system 16 has been activated, the compression braking function provides a torque which controls the speed of vehicle 12 without the use of the vehicle's friction braking system and/or which supplements the braking torque produced by the vehicle's friction braking system.

Controller 20 then proceeds to step 40 and determines whether the vehicle's speed is increasing (e.g., controller 20 determines whether the additional torque provided by the compression braking system 16 has slowed the vehicle 12). If the vehicle's speed is no longer increasing, controller 20 proceeds to step 50. Otherwise, if the vehicle's speed continues to increase, controller 20 proceeds to step 42 and determines whether the engine 14 is operating in a low compression ratio mode. If the engine 14 is in high compression ratio mode, controller 20 proceeds to step 44 and downshifts the vehicle until the vehicle speed stops increasing. Particularly, controller 20 communicates a signal to transmission 18, effective to cause transmission 18 to shift into the next lowest gear. If the vehicle's speed continues to increase, controller 20 communicates another signal to transmission 18 to shift into the next lowest gear. This process will continue until the transmission is in its lowest gear or until the vehicle's speed ceases to increase. Once the vehicle's speed "levels off" or begins to decrease, controller 20 proceeds to step 50.

If in step 42, the controller 20 determines that the vehicle's engine 14 is operating in a low compression ratio mode, controller 20 proceeds to step 46 and switches to high compression ratio mode. Particularly, controller 20 communicates a signal to engine 14, effective to cause engine 14 to switch from low compression ratio mode to high compression ratio mode. By switching to high compression ratio mode, the braking torque provided by the compression braking function is desirably increased. Controller 20 then proceeds to step 48 and determines whether the vehicle's speed continues to increase. If the vehicle's speed is still increasing after switching to high compression ratio mode, controller 20 proceeds to step 44. Otherwise, controller 20 proceeds to step 50.

Controller 20 continues to monitor the vehicle's speed once the speed begins to decrease, and in step 50, controller 20 determines whether the vehicle speed has fallen below a predetermined minimum threshold value, $V_{d,min}$. If the vehicle's speed is not less than $V_{d,min}$, controller 20 takes no further action and the strategy is repeated. If the vehicle's speed falls below $V_{d,min}$, controller 20 proceeds to step 51 and determines whether compression braking is activated. If compression braking is not activated, controller 20 takes no further action and repeats the strategy. If compression braking is activated, controller 20 proceeds to step 52 and determines whether the vehicle is operating in a high compression ratio mode. If the vehicle is not operating in high compression ratio mode, controller 20 proceeds to step 56. Otherwise, controller 20 proceeds to step 54. In step 54, controller 20 switches to low compression ratio mode. Particularly, controller 20 communicates a signal to engine 14, effective to cause engine 14 to switch from high compression ratio mode to low compression ratio mode. By switching to low compression ratio mode, the braking torque provided by the compression braking function is desirably decreased. Controller 20 then proceeds to step 56 and determines whether the vehicle's speed continues to decrease. If the vehicle's speed continues to decrease in step 56, controller 20 proceeds to step 58. If the vehicle's speed does not continue to decrease, controller 20 continues to use compression braking to slow vehicle 12, and once the vehicle's speed begins to decrease again, controller 20 proceeds to step 58. In step 58, controller 20 communicates a signal to transmission 18 to shift to the next highest gear. Controller 20 will continue to "up-shift" the transmission 18 until the highest gear is reached. Controller 20 then ends compression braking and communicates a signal to engine 14, effective to begin delivering fuel to the various cylinders of the engine 14.

In this manner, system 10 and method 30 controllably vary the compression braking torque. System 10 and method 30 thereby provide a smoother and more flexible compression braking function with additional braking torque capabilities. In other alternate embodiments, system 10 can be adapted to provide further flexibility and control by selectively activating compression braking in less than all of the cylinders of the engine, or by selectively altering the compression ratio in less than all of the cylinders of the engine.

It should be understood that Applicant's inventions are not limited to the exact system 10 and method 30, which have been described herein, but that various changes and/or modifications may be made without departing from the spirit and/or the scope of Applicant's inventions. For example and without limitation, method 30 may include different or additional steps or strategies and may perform the disclosed steps and/or other steps in a different order or manner.

What is claimed is:

1. A system for braking a vehicle having a transmission, said system comprising:

a variable compression ratio engine which is selectively operable in a high compression ratio mode and in a low compression ratio mode;

a compression braking system which selectively provides a compression braking torque; and a controller which is communicatively coupled to said variable compression ratio engine, to said compression braking system, and to said transmission, said controller being effective to activate said compression braking system and to selectively cause said variable compression ratio engine to switch between said high compression ratio mode and said low compression ratio mode while said compression braking system is activated, thereby selectively varying said compression braking torque, wherein said controller further determines whether said variable compression ratio engine is operating in a low compression ratio mode and whether the speed of said vehicle is increasing and, upon said determination that said vehicle is operating in said low compression ratio mode and said speed of said vehicle is increasing, said controller downshifts said transmission only if said compression braking system is activated.

2. The system of claim 1 further comprising:

a sensor which is adapted to measure a speed of said vehicle; and wherein said controller is further communicatively coupled to said sensor and is effective to activate said compression braking system when said vehicle is being braked and said speed of said vehicle exceeds a predetermined value.

3. The system of claim 1 wherein said variable compression ratio engine is of the type having a plurality of auxiliary chambers which are selectively and communicatively coupled to cylinders of said engine and which are selectively opened and closed to alter the compression ratio of said engine.

4. The system of claim 1 wherein said variable compression ratio engine is of the type having a plurality of selectively extendable pistons.

5. A method for braking a vehicle of the type having a compression braking system, a variable compression ratio engine, and a transmission, said method comprising the steps of:

activating said compression braking system, effective to produce a braking torque;

selectively altering the compression ratio within said variable compression ratio engine, thereby altering said produced braking torque; and providing a controller and communicatively coupling said controller to said compression braking system, to said variable compression ratio engine, and to said transmission, wherein said controller further determines whether said variable compression ratio engine is operating in a low compression ratio mode and whether the speed of said vehicle is increasing and, upon said determination that said vehicle is operating in said low compression ratio mode and said speed of said vehicle is increasing, said controller downshifts said transmission only if said compression braking system is activated, thereby assisting said compression braking system.

6. The method of claim 5 further comprising the steps of:

measuring a speed of said vehicle; and selectively activating said compression braking system only if said measured speed exceeds a predetermined value.

7. The method of claim 6 further comprising the steps of:

selectively decreasing the compression ratio of said engine if said speed of said vehicle is decreasing and is below a second threshold value and said compression braking system is activated.

8. The method of claim 6 further comprising the steps of:

selectively increasing the compression ratio of said engine if said speed of said vehicle is increasing and exceeds a first threshold value and said compression braking system is activated, thereby increasing said produced braking torque.

9. The method of claim 8 further comprising the steps of:

selectively shifting said transmission to a lower gear if said speed of said vehicle continues to increase after said compression ratio of said engine has been increased and after said transmission has been downshifted.

10. The method of claim 8 further comprising the steps of:

selectively shifting said transmission to a higher gear if said speed of said vehicle continues to decrease after said compression ratio of said engine has been decreased.

11. A method of braking a vehicle of the type having a compression braking system, a variable compression ratio engine, and a transmission, said method comprising the steps of:

measuring a speed of said vehicle;

activating said compression braking system if said measured speed exceeds a first threshold value;

determining whether said speed of said vehicle is increasing after said compression braking system has been activated;

increasing the compression ratio of said variable compression ratio engine if said speed of said vehicle is increasing after said compression braking system has been activated; and determining whether said speed of said vehicle continues to increase after said compression ratio of said variable compression ratio engine has been increased and, upon a determination that said speed of said vehicle is continuing to increase, automatically downshifting said transmission until said speed of said vehicle begins to decrease.

12. The method of claim 11 further comprising the steps of:

determining whether said speed of said vehicle has fallen below a second threshold value; and decreasing said compression ratio if said speed of said vehicle has fallen below said second threshold value and said compression braking system is activated.

13. The method of claim 12 further comprising the steps of:

determining whether said speed of said vehicle is decreasing after said compression ratio has decreased; and shifting said vehicle to a higher gear if said speed of said vehicle is decreasing after said compression ratio has decreased.

14. The method of claim 13 further comprising the step of:

deactivating said compression braking system if said speed of said vehicle continues to decrease after said vehicle has been shifted to a higher gear.

15. The method of claim 14 wherein said variable compression ratio engine is of the type having a plurality of auxiliary chambers which are selectively and communicatively coupled to cylinders of said engine and which are selectively opened and closed to alter the compression ratio of said engine.

16. The method of claim 14 wherein said variable compression ratio engine is of the type having a plurality of selectively extendable pistons.

* * * * *